US006985061B2

(12) United States Patent
Hafskjold et al.

(10) Patent No.: US 6,985,061 B2
(45) Date of Patent: Jan. 10, 2006

(54) ARRANGEMENT AND METHOD FOR INSTALLING A SUBSEA TRANSFORMER

(75) Inventors: Gunnar Hafskjold, Drammen (NO); Nils Arne Soelvik, Houston, TX (US)

(73) Assignee: Vetco Aibel AS, Billingstad (NO)

( * ) Notice: Subject to any disclaimer, the term of this patent is extended or adjusted under 35 U.S.C. 154(b) by 80 days.

(21) Appl. No.: 10/333,119

(22) PCT Filed: Jul. 2, 2001

(86) PCT No.: PCT/IB01/01185

§ 371 (c)(1),
(2), (4) Date: Jul. 2, 2003

(87) PCT Pub. No.: WO02/09130

PCT Pub. Date: Jan. 31, 2002

(65) Prior Publication Data

US 2004/0090297 A1 May 13, 2004

(30) Foreign Application Priority Data

Jul. 24, 2000 (NO) ..... 20003793

(51) Int. Cl.
*H01F 27/02* (2006.01)

(52) U.S. Cl. ..... 336/90; 336/57; 336/58; 336/94

(58) Field of Classification Search ..... 336/90, 336/57, 58, 94, 55
See application file for complete search history.

(56) References Cited

U.S. PATENT DOCUMENTS

| | | | | |
|---|---|---|---|---|
| 3,618,661 | A | 11/1971 | Petterman | |
| 4,422,791 | A | 12/1983 | Lausberg et al. | |
| 6,456,179 | B1 * | 9/2002 | Backa et al. | 336/57 |

FOREIGN PATENT DOCUMENTS

| | | | |
|---|---|---|---|
| DE | 10127276 | A1 * | 1/2003 |
| FI | WO 99/63555 | * | 12/1999 |
| GB | 2342713 | | 4/2000 |
| GB | 2381667 | B | 11/2004 |
| SU | 1826087 | | 7/1993 |
| WO | WO 9923350 | A1 | 5/1999 |

* cited by examiner

*Primary Examiner*—Lincoln Donovan
*Assistant Examiner*—Jennifer A. Poker
(74) *Attorney, Agent, or Firm*—Venable LLP; Eric J. Franklin

(57) ABSTRACT

An arrangement and a method for use in installation procedures for subsea transformers. A central, hole or tube is included in an encapsulation enclosing a transformer that is to be installed. Three core elements of the transformer are arranged symmetrically around the hole or tube forming a triangle or a delta. The transformer is lowered towards a a foundation placed on the sea floor wherein a guide pin is mounted. When the transformer has found its way to the foundation, the guide pin will enter the tube, and the transformer will slide down onto the guide line pin. The tube is terminated by a funnel shaped opening, thus making it easier not to miss the guide pin by the tube opening. The transformer is horizontally oriented by means of orientation keys localized within the tube.

14 Claims, 3 Drawing Sheets

ARRANGEMENT AND METHOD FOR INSTALLING A SUBSEA TRANSFORMER

FIELD OF THE INVENTION

The present invention relates to offshore installations, and in particular to an arrangement and a method for use in installation procedures for subsea transformers.

BACKGROUND OF THE INVENTION

Today's offshore industry requires a great deal of subsea completions. Especially, the subsea power distribution systems to and between e.g. oil platforms or other offshore power consumers, include a lot of relatively large and heavy components, such as transformers.

The installation process of these components may be both complicated and demanding because of the strong and unpredictable environment the installers encounter. Additionally, the installers have less control over the components because the installation often has to be done remotely, e.g. from a boat. Thus, during the process, there is a considerable risk of damaging the components, and if the installation fails, there are often limited possibilities for correction.

Installation of transformers used in subsea power distribution systems is an example of such a risky installation process. A common technique when installing subsea transformers is to slowly lower the transformer from e.g. a boat, towards a foundation localized on some desired place at the bottom of the sea. Conventionally, transformers are rectangular shaped, and proper placement is ensured by means of two or four guide pins positioned at the edges of the foundation. The guide pins are adapted to fit into some funnels positioned at the transformer's edges such that when the funnels enter all the guide pins, the transformer is meant to be secured a correct position and orientation.

The main drawback of the installation process mentioned above is that large objects, in particular rectangular ones, are widely exposed to underwater currents when being lowered. Experience has shown that they tend to twist around during deployment, especially in depths where guide wires are not used. This fact makes it difficult to enter the guide pins with the funnels placed at the edges of the transformers, all at the same time.

Moreover, even if the installation apparently has succeeded, the orientation of the transformer may differ 90 or 180 degrees from the correct orientation, if the guide pins have been entered in wrong funnels.

A further drawback is that the transformer risks to jam/wedge between the guide pins, if the installation fails. This may cause damage, or even loss, of the transformer which is to be installed.

Moreover, the transformer may be overturned by the guide pins when sighting the transformer, and this may also cause damage or loss.

SUMMARY OF THE INVENTION

The object of the present invention is to provide a device and a method, which eliminates the drawbacks described above.

More specifically, the main object of the present invention is to develop a device that may be integrated with subsea components to secure and simplify the installation process.

In short, in a preferred embodiment of the invention, the object is achieved by introducing a central, (through-going or not) tube (from now on referred to as a receiving channel) in the encapsulation enclosing the transformer which is to be installed. The core elements of the transformer are arranged symmetrically around the receiving device forming a triangle or a delta. In the installation process, a single guide pin mounted in the foundation placed on the sea floor will enter the receiving channel, and the encapsulation will slide down on the guide pin. The receiving channel is terminated by a funnel shaped opening, thus making it easier to enter the guide pin.

BRIEF DESCRIPTION OF THE DRAWINGS

In order to make the invention more readily understandable, exemplary embodiments of the present invention will in the following be described with reference to the accompanying drawings.

FIG. 5 shows an indication of how a second embodiment of the present invention may look like.

DETAILED DESCRIPTION

With reference to the abovementioned figures, there will in the following be described three exemplary embodiments of the present invention.

Figure 1:
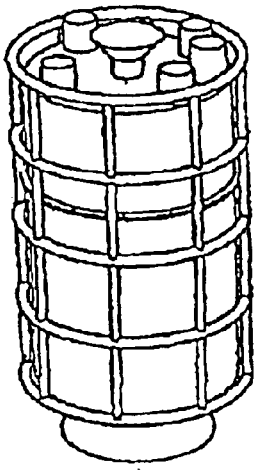
FIG. 1 shows a 3-D view of a subsea transformer comprising a receiving channel according to a first preferred embodiment of the present invention.

FIG. 1 shows a cylindrical subsea transformer including the receiving channel of the present invention. In this embodiment, the receiving channel (1) runs through the transformer from the top, all the way to the bottom. The channel does not necessarily have to be through-going. However, it has to be localized in the centre of the cylinder forming the transformer body.

Figure 2:
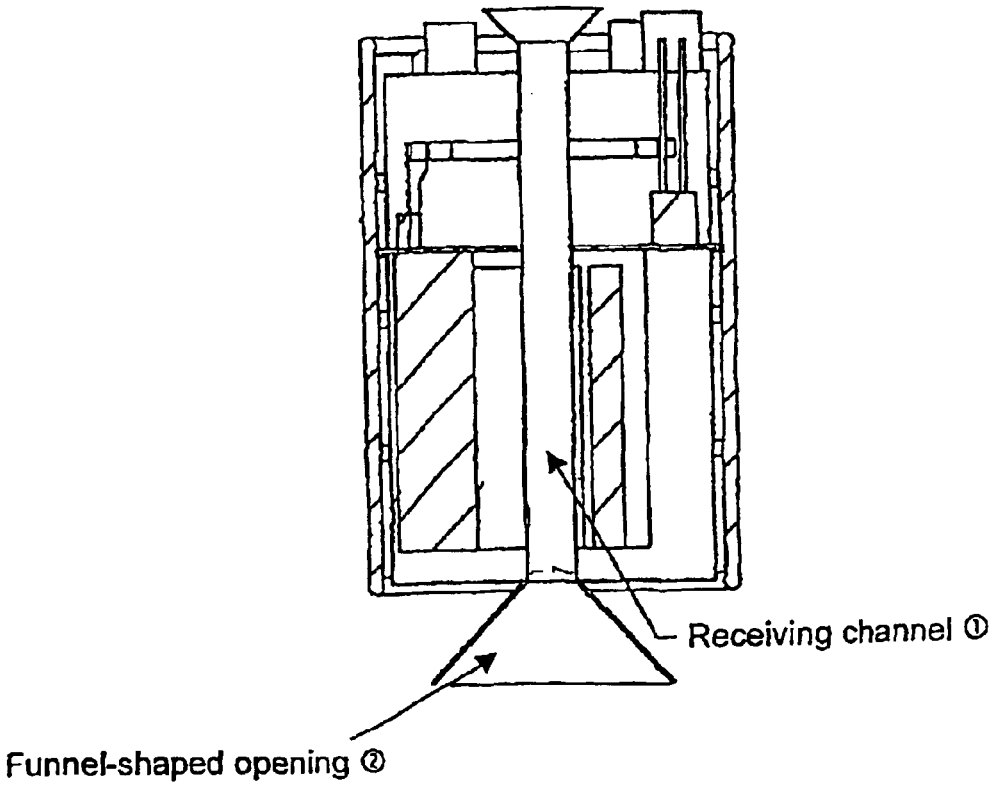
FIG. 2 shows a sectional elevation of the subsea transformer of FIG. 1.

This is illustrated even better in FIG. 2, which shows a sectional elevation of the transformer. The receiving channel (1) is placed at the exact center to make it possible to use only one guide pin (4) in the installation process. Moreover, the centering makes the transformer more stable and easier to handle during installation.

It is also shown that the receiving channel (1) is terminated at the bottom by a funnel-shaped opening (2). This is done for "broadening" the receiving channel's opening, when sighting it on the guide pin (4) positioned on the foundation. When the top of the guide pin (4) finds its way somewhere within the funnel-shaped opening (2), the funnel-shaped opening (2) will then center the receiving channel (1) with respect to the guide pin (4), which enables the transformer body to be lowered correctly over the guide pin (4).

In addition, the lower part of the receiving channel (1) includes orientation keys. These orientation keys should be positioned in a way so that it will orientate the transformer body to a desired, predetermined horizontal orientation relative to the foundation.

Figure 3:
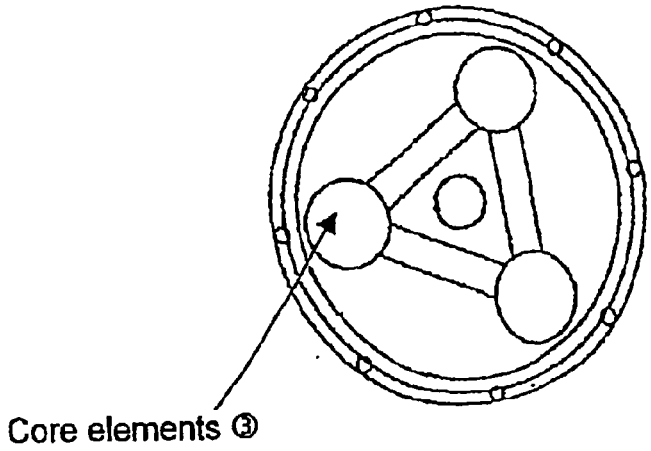
FIG. 3 shows a cross sectional view of the subsea transformer of FIG. 1.

FIG. 3 is a cross-sectional view of the subsea transformer, and illustrates how the core elements (3) are arranged around the central receiving channel (1). In this embodiment, the transformer core consists of three elements. The elements are localized symmetrically around the receiving channel (1), forming a triangle or delta. This implies that adjacent elements are equally spaced, all having the same distance to the central receiving channel (1). This allows the transformer body to be cylindrical or, alternatively, oval or multi-edged.

Figure 4:
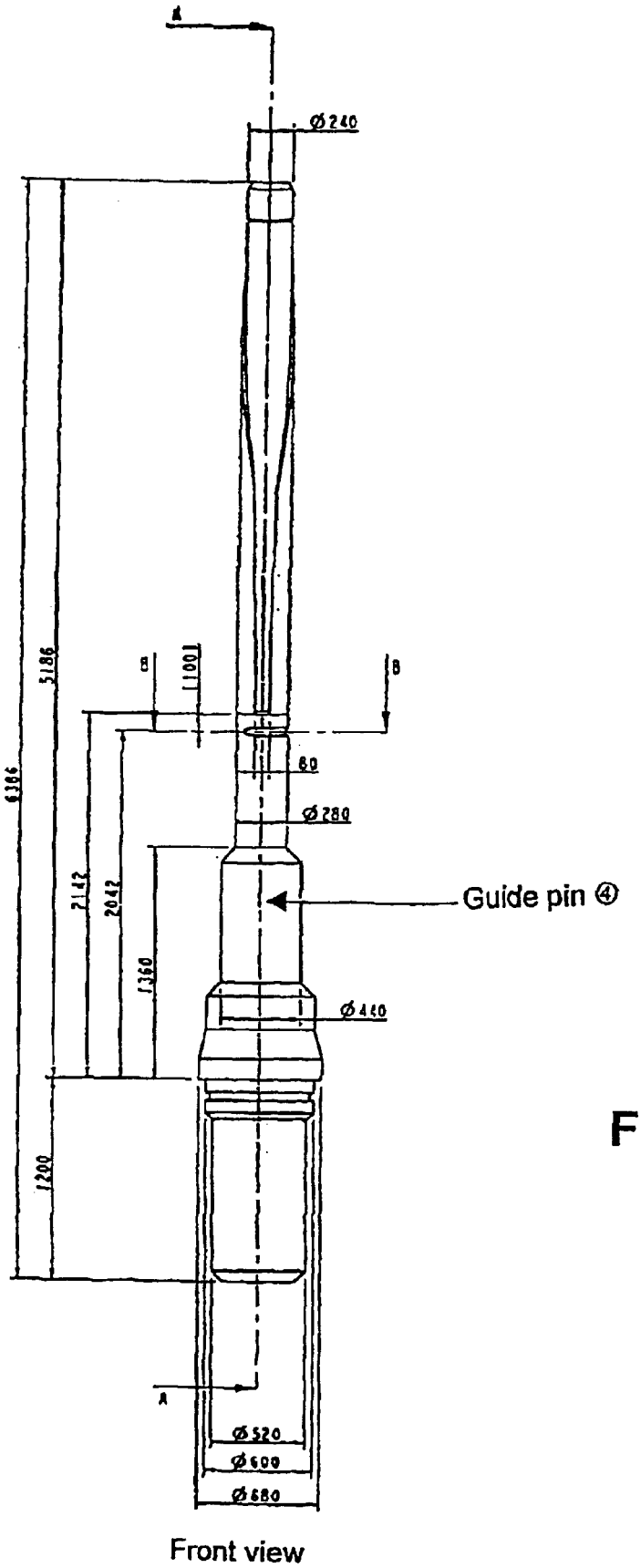
FIG. 4 shows a sectional elevation of a guide pin (4) according to a first embodiment of the present invention.

FIG. 4 shows a sectional elevation view of a guide pin (4) mounted on a foundation. The guide pin (4) has approximately the same length as the central receiving channel (1) of the transformer. Moreover, the diameter of the guide pin (4) must not exceed the inner diameter of the central receiving channel (1), but should be dimensioned to smoothly fit into the receiving channel (1). Thus, wavering, when the transformer is lowered over the guide pin (4), is prevented.

The process for installing the transformer described above starts by lowering the transformer body towards the guide pin (4), until it is placed just above the guide pin (4) and the funnel-shaped opening (2) encapsulates the top of it. The transformer is then further lowered down, so that the funnel-shaped opening (2) "lead" the receiving channel opening towards the top of the guide pin (4). When reaching it, the receiving channel (1) will be lowered over the guide pin (4), and the transformer body will smoothly slide down towards the foundation. Finally, the transformer body is oriented horizontally until the orientation keys have positioned the receiving channel (1) to the guide pin (4), leaving the transformer body in a predetermined, desired horizontal orientation relative to the foundation.

Figure 5:
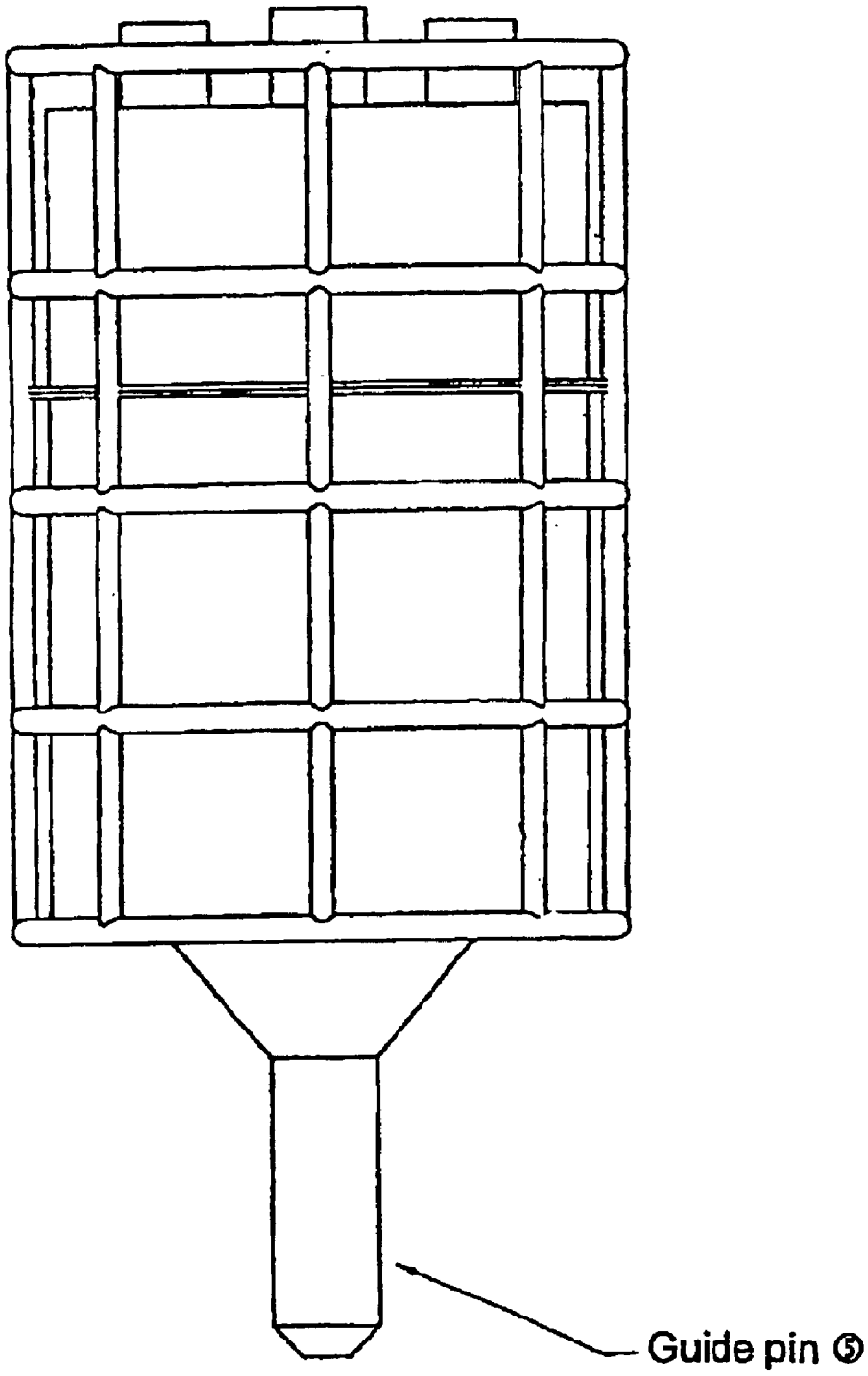

A second embodiment of the present invention is indicated in FIG. 5. This is an "inverted version" of the first embodiment described above. Here, the guide pin (5) and the receiving channel are switched, i.e. the guide pin (5) is axially mounted on the bottom side of the encapsulation, and the receiving channel is mounted in the seafloor foundation (not shown). However, the core elements (3) of the transformer still have to be symmetrically mounted around a central axis running parallel to the core elements, as in the case of the first embodiment. The funnel-shaped opening is now terminating the receiving channel on the top entrance. The method for installing the transformer in the second embodiment differs from the method of the first embodiment in that now, it is the guide pin (5) that is lead to and lowered down into the receiving channel.

In a third embodiment of the invention, the transformer body works as the guide pin itself. As in the second embodiment, the receiving channel is mounted in the seafloor foundation, but it is now adapted to receive and encapsulate the whole transformer body. The method for installing the transformer in the third embodiment differs from the method of the second embodiment in that now, the whole body is being lowered down into the receiving channel.

The above mentioned embodiments for installing a subsea transformer on a foundation at the sea floor have several advantages. Firstly, the present invention allows the transformer to be formed cylindrically, oval or multi-edged. Generally, it is much easier to handle and place objects formed in such a way under water, as opposed to rectangular objects, such as conventional subsea transformers. Rounded encapsulations are e.g. not as vulnerable to underwater currents as rectangular ones, and this is especially important in depths where guide wires are not used.

Further, in the present invention only one opening has to find its way to one single guide pin during the installation process, and it is obvious that this is considerably easier than when several guide pins and funnels are involved.

Moreover, the present invention eliminates the possibility for the transformer to be wedged between guide pins, since only one single pin is being used. Thus, the risk of loss of or damage to the components will decrease.

Finally, because of the symmetrical forming, the fact that only one single guide pin is being used, and because of the orientation keys, the present invention ensures that the horizontal orientation will be taken care of in a more convenient way.

Note that the foregoing embodiments of the present invention are discussed for illustrative purposes, and are not meant to limit the invention in any way. Nevertheless, different changes and supplements may be added without departing the scope of the invention defined in the following claims.

What is claimed is:

1. An arrangement for installing a subsea transformer, said arrangement comprising an engagement means for engaging with a corresponding guide means mounted in a seafloor foundation, wherein said engagement means comprises a receiving channel, said guide means comprises a guide pin, and said transformer comprises a plurality of core elements symmetrically enclosing said receiving channel so that said receiving channel forms a central axis parallel to said core elements, said receiving channel being adapted for receiving said guide pin.

2. The arrangement according to claim 1, wherein said core elements are arranged in a delta formation around said receiving channel.

3. The arrangement according to claim 1, wherein said subsea transformer is encapsulated by a cylindrically or multi-edged capsule.

4. The arrangement according to claim 1, wherein said receiving channel is terminated by a funnel-shaped opening at the entrance end.

5. The arrangement according to claim 1, wherein said receiving channe includes orientation keys for adjusting said receiving channel and thereby the transformer to a desired, predetermined, horizontal orientation relative to said seafloor foundation.

6. A method for installing a subsea transformer, said method, the method comprising: engaging and engagement means with a corresponding guide means mounted in a seafloor foundation, wherein said engagement means comprises a receiving channel, said guide means comprises a single guide pin, said transformer comprises a plurality of core elements symmetrically enclosing said receiving channel so that said receiving channel forms a central axis parallel to said core elements, said receiving channel being adapted for receiving said guide pin, when said receiving channel is lowered onto said guide pin.

7. An arrangement for installing a subsea transformer, said arrangement comprises a guide means for engaging with a corresponding engagement means mounted in a seafloor foundation, wherein said engagement means comprises a receiving channel, said guide means comprises a guide pin, and said transformer comprises a plurality of core elements symmetrically enclosing a central axis running parallel to said core elements, and said receiving channel being adapted for receiving said guide pin.

8. The arrangement according to claim 7, wherein said subsea transformer is encapsulated by a cylindrically, oval or multi-edged capsule.

9. The arrangement according to claim 7, wherein said guide pin being axially mounted on the bottom side of said transformer.

10. The arrangement according to claim 7, wherein said guide pin is the transformer body itself.

11. The arrangement according to claim 7, wherein said core elements are arranged in a delta-formation.

12. The arrangement according to claim 7, wherein said receiving channel is terminated by a funnel-shaped opening at the entrance top.

13. The arrangement according to claim 7, wherein said receiving channel includes orientation keys for adjusting said guide pin and thereby the transformer to a desired, predetermined, horizontal orientation relative to said seafloor foundation.

14. A method for installing a subsea transformer, said method comprising:

engaging a guide means with a corresponding engagement means mounted in a seafloor foundation, wherein said engagement means comprises a receiving channel, said guide means comprises a guide pin, and said transformer comprises a plurality of core elements symmetrically enclosing a central axis running parallel to said core elements, when said receiving channel is adapted for receiving said guide pin, said guide pin being lowered into said receiving channel.

* * * * *